US006681461B1

(12) United States Patent
Catallo

(10) Patent No.: US 6,681,461 B1
(45) Date of Patent: Jan. 27, 2004

(54) DUAL-SLIP COMPRESSIVE SHRINK-PROOFING APPARATUS FOR FABRIC AND RELATED METHOD

(76) Inventor: Frank Catallo, 84 Wheatley Rd., Old Westbury, NY (US) 11568

( * ) Notice: Subject to any disclaimer, the term of this patent is extended or adjusted under 35 U.S.C. 154(b) by 289 days.

(21) Appl. No.: 09/694,053

(22) Filed: Oct. 20, 2000

(51) Int. Cl.[7] ..... D06C 21/00; D06C 15/04

(52) U.S. Cl. ..... 26/18.6; 28/142

(58) Field of Search ..... 26/18.6, 18.5, 26/80, 81, 69 A; 28/142, 116, 134, 135, 136, 137, 138, 139, 165, 155, 156; 162/110, 280, 281, 282, 361

(56) References Cited

U.S. PATENT DOCUMENTS

| | | | | | |
|---|---|---|---|---|---|
| 3,015,145 | A | * | 1/1962 | Cohn et al. | 26/18.6 |
| 3,015,146 | A | * | 1/1962 | Cohn et al. | 26/18.6 |
| 3,083,435 | A | * | 4/1963 | Cohn et al. | 26/18.6 |
| 3,196,723 | A | | 7/1965 | Cohn et al. | |
| 3,329,562 | A | * | 7/1967 | Schaefer | 162/361 |
| 3,431,608 | A | * | 3/1969 | Reiners | 26/18.6 |
| 3,471,907 | A | * | 10/1969 | Beckers | 26/18.6 |
| 3,581,614 | A | | 6/1971 | Catallo | |
| 3,973,303 | A | | 8/1976 | Diggle, Jr. | |
| 4,103,402 | A | | 8/1978 | Frezza | |
| 4,142,278 | A | * | 3/1979 | Walton et al. | 26/18.6 |
| 4,447,938 | A | * | 5/1984 | Catallo | 26/18.6 |
| 4,689,862 | A | | 9/1987 | Catallo | |
| 5,012,562 | A | | 5/1991 | Catallo | |
| 5,016,329 | A | | 5/1991 | Milligan et al. | |
| 5,117,540 | A | * | 6/1992 | Walton et al. | 26/18.6 |
| 5,553,365 | A | * | 9/1996 | Catallo | 26/18.6 |
| 5,655,275 | A | | 8/1997 | Allison | |
| 5,678,288 | A | * | 10/1997 | Walton et al. | 26/18.6 |

* cited by examiner

*Primary Examiner*—Amy B. Vanatta
(74) *Attorney, Agent, or Firm*—Charles E. Baxley

(57) ABSTRACT

A method and related apparatus for shrink-proofing a fabric, typically a knitted textile composed of interlocked loops of yarn made of natural and/or man-made fibers. The loops interlock along stitch rows that may become skewed. According to the invention the fabric is confined from expanding as it is delivered to and discharged from an in-line compression zone free of obstructions such as crimps, bends or kinks. The fabric is confined, preferably resiliently, coming to, passing through and leaving the compression zone so as to accommodate variation of thickness and irregularities of the fabric being compacted in the compression zone. The interlocked loops are organized whereby they are allowed to move toward each other orthogonally along their related stitch row so as to reduce volume of the fabric. Non-woven textiles, papers, papers with additives and the like are shrink-proofed in the same manner.

32 Claims, 11 Drawing Sheets

DUAL-SLIP COMPRESSIVE SHRINK-PROOFING APPARATUS FOR FABRIC AND RELATED METHOD

BACKGROUND OF THE INVENTION

DISCUSSION

The knitting industry uses, for manufacture of garments, various compacted knitted textile fabrics of different constructions generally accepted as having been shrink-proofed. For such compressive shrink-proofing, two-pass types of compactors have been in vogue, as disclosed in each of U.S. Pat. Nos. 4,689,862 and 5,655,275; which compactors are typical of machines used for knitted fabric made of natural and/or man-made fibers. Although these compactors produce generally acceptable shrink-proofing results, they are temperamental and require frequent re-adjusting of their compression zones.

U.S. Pat. No. 5,016,329 uses two stationary opposing blades to form a compression zone. A fabric being compacted is required to change direction abruptly on entering and exiting a compression zone. Applicant's GULL-WING brand compactor, disclosed in U.S. Pat. No. 5,012,562, employs a compression zone consisting of an apex (or nadir) of a stationary notched shoe and an opposing impact blade with the fabric being compacted required to make a "V" turn in passing through a compression zone. Common to the prior art compactors presently used for shrink-proofing knitted textile fabrics is a requirement for an abrupt change of direction of fabrics due to an organized obstruction in their respective compression zones. The abrupt change of direction contributes to jamming, for example, at the apex of the GULL-WING brand compactor. A single-pass in-line compression zone introduced in Applicant's present invention eliminates the abrupt change of direction to render the compactor of the present invention more operator-friendly, knit-friendly and produces trouble-free superior shrink-proofing on a wide variety of constructions of knitted textile fabrics and other fabrics having characteristics kindred to knitted textile fabrics.

THEORY

Compressive shrink-proofing of knitted textile fabrics, formed from interlocked loops of yarns made usually of natural fibers or man-made fibers had its origin in shrink-proofing of woven textile fabric webs. With increased popularity of knitted garments, compressive shrink-proofing of knitted textile fabrics evolved from prior experience obtained by working with flat woven textile fabric webs. Woven textile fabrics webs are rectilinear grids of threads having longitudinal warp threads interwoven by transverse fill threads. Emphasis in compaction for shrink-proofing of woven textile fabric webs naturally focused on a need for longitudinal compression. The woven textile fabrics were and are manufactured in such continuous webs which inevitably get stretched lengthwise while being woven, transported and processed. So it was and is logical, convenient and effective to shrink compressively the woven fabric webs in a longitudinal direction along their continuous webs. However, knitted textile fabrics, like randomly deposited fabrics made of natural or man-made fibers, are neither formed nor structured similarly to woven textile fabrics.

Knitted textile fabrics, for example, are composed of yarns, usually of natural fibers, formed in interlocking curvilinear loops which are arranged in stitch rows sometimes aligned perpendicularly to and sometimes skewed from perpendicular orientations relative to alignment of their continuous webs. The loops generally interlock with each other substantially at right angles (orthogonally) to their respective stitch rows. It is sometimes convenient to visualize stitch rows ideally as being straight and aligned transversely relative to a longitudinal path of the fabric, like soldiers marching on parade through their compactor. Yet such an ideal image of stitch rows through a compactor rarely finds its counterpart in the real world. Knitted textile fabrics frequently are not designed with straight transverse stitch rows. Handling and treatment of knitted textile fabrics, warp, bend, twist and otherwise distort their stitch rows. Further, the stitch rows themselves are formed as a progression of repeating series of curvilinear loops of yarn. So as far as compacting of knitted textile fabrics is concerned, terms such as "straight" or "aligned" stitch rows are wishful euphemisms.

A loop of yarn in a knitted fabric actually exhibits behavior characteristics quite different from those that logically might be expected from an ideal image of stitch rows. Applicant examined behavioral characteristics of actual knitted structures as they undergo compaction, so as to deal with on their own terms with the loops and stitch rows as they actually exist in the real world.

The knitted textile fabrics, when composed of natural fibers, typically are manufactured in the form of continuous tubes which are then flattened and compacted in a longitudinal direction analogous to compacting of woven textile fabrics. Alternately the knitted tubes may be split open, spread and subjected to longitudinal compacting as open webs. Knitted textile fabrics, with small loops or fine yarns making up the loops, require compaction as open webs. As has been noted herein, technology which evolved from compacting of woven textile fabric webs generally has achieved inconsistent success in treating knitted textile fabrics. Lack of consistent success has been common to compaction of knitted textile fabrics both as tubes and as open webs. Accordingly some people look upon compressive shrinking of knitted fabrics as an occult art.

In actual knitted textile fabrics we frequently can expect unreliable orientation (skewing) of stitch rows formed of interlocked yarn loops. An alignment of the loops has been recognized by Applicant to occur orthogonally each individual loop relative to its related skewed stitch row. Applicant's recognition, acceptance and accommodation of the skewed orientation of the stitch rows and inherent behavior of the loops relative to their respective stitch rows are at a crux of Applicant's successful, consistent and reliable compacting of knitted textile fabrics and other similar fabrics made of natural and/or man-made fibers. It followed that organizing apparatus and a related method for freeing the interlocked loops of yarn to move easily, as they naturally choose, toward each other orthogonally relative to their skewed stitch rows opened the door to Applicant's success.

Effective compressive shrink-proofing of knitted textile fabrics of natural fibers depends in part on expansion of heated and/or moistened yarn caused by partial unraveling of their fibers. Steam puffing and lubricating effects on nautral yarn loops of knitted textile fabrics are discussed in Applicant's U.S. Pat. No. 4,447,938 whose disclosure is included herein by reference. Another reality of compaction is that the fabric reduces in volume by mechanical pushing of the interlocked loops of yarn preferably toward each other. The present invention focuses on the mechanical pushing action.

The loops interlock generally at right angles (orthogonally) each relative to its related stitch row. With the stitch rows unreliably organized, and the yarn loops arranged orthogonally thereto, application of longitudinal compaction through a crimped, bent, kinked or otherwise obstructed compression zone was effective along a series of longitudinal vectors from a continuum of points along a curvilinear loop of yarn. Simultaneously, a series of companion transverse vectors of any or all of the same points could thereby be either wasted or they could contribute to counterproductive stretching. Accordingly a substantial portion of longitudinal compacting effort on knitted textile fabrics was self-defeating when performed through the crimped, bent, kinked or otherwise obstructed compression zones of the prior art. By eliminating abrupt direction change, due to obstruction, as the web of knitted fabric passes through the compression zone, Applicant frees the loops each to move according to its own natural preference, which he recognized to be orthogonally relative to its related stitch row, unaffected by likely skewed orientations of the stitch rows that make up the web of knitted fabric.

Applicant here approaches compacting of knitted textile fabrics by delivering and removing a confined web of the fabric, usually heated and/or moistened, through a substantially in-line compression zone wherein the loops of yam of the fabric web, while expanding due to partial unraveling, are allowed to reduce in volume by the loops being pushed together each according to its own natural preference orthogonally relative to a skewed axis of its respective stitch row. By eliminating crimps, bends, kinks and other obstructions at the compression zone, Applicant avoids limiting the compacting effort to being only longitudinally directed relative to the fabric web and thus Applicant avoids the counterproductive stretching. Employing this approach Applicant allows the expanding loops to move as they choose according to inherent influences of their composition, history and knitted structure in the easiest and most natural way they can find so as to each reduce its own volume. By this teaching, the direction of movement of the interlocked yam loops is toward each other orthogonally relative to their respective stitch rows, independent of how bent, warped, twisted or otherwise skewed those stitch rows may be.

Because of Applicant's novel, useful and non-obvious approach, his present apparatus is inexpensive to build, easy to operate and more reliable than apparatuses of the prior art. He achieves operator-friendly, knit-friendly, superior and more reliable compaction of knitted textile fabrics and similar fabrics than has heretofore been achievable. His compactor contributes toward its goal by eliminating counterproductive tensions. He achieves his objective without polishing, crimping or grabbing of the knitted fabric. Applicant's apparatus and related method for shrinking of knitted textile fabrics made of natural fibers also is applicable to fabrics made from manmade fabrics, non-woven textiles, papers, papers with additives, and the like; because their formations and structural characteristics are generally random and much more similar to those of knitted textile fabrics than they are to those of woven textile fabrics. Further, Applicant's invention is easily retrofittable into a wide variety of existing compressive shrink-proofing apparatuses. Single-station double-roller compressive shrink-proofing apparatuses are the most likely candidates for retrofitting.

SUMMARY AND OBJECTS OF THE INVENTION

It is therefore an object of the present invention to provide an apparatus and related method to produce superior-quality controlled permanent compaction of knitted textile and similar fabrics.

It is a further object of the present invention to provide an in-line, short smooth compression zone without bends, crimps, kinks or similar obstructions.

It is a further object of the present invention to provide setting of gap width by moving either a feeding surface or a retarding surface toward or away one from the other, for example, by moving either a retarding roller or a feeding roller toward or away from the other, or by moving one endless belt toward or away from a companion endless belt.

It is a further object of the present invention to provide resilient loading against the fabric for example by applying pneumatic pressure onto confining shoes.

It is a further object of the present invention to provide apparatus to maintain the fabric in dual frictional engagement with either a feeding surface (on one side of the fabric) or a retarding surface (on the other side) in tandem, not simultaneously so as to avoid polishing, crimping or grabbing of the knitted fabric. Alternately the fabric can be introduced in engagement with an entry roller and then discharged in engagement with a retarder roller.

It is a further object of the present invention to treat evenly both sides of a tube of the knitted and similar fabrics.

It is a further object to provide apparatus for carrying out the present invention which apparatus is easily retrofittable into a wide variety of existing compressive shrink-proffing apparatuses.

It is a further object of the present invention to treat effectively tubular knitted fabrics avoiding sidedness of the finished fabric.

It is a further object of the present invention to shrink compressively knitted and similar fabrics free from counterproductive tension.

It is a further object of the present invention to shrink compressively knitted textile fabrics in a single pass.

It is a further object of the present invention to shrink compressively knitted and similar fabrics free from scorching, polishing, crimping and grabbing.

It is a further object of the present invention to accommodate compacting of knitted textile fabrics or similar fabrics in either closed tubes or open webs.

It is a further object of the present invention to provide an apparatus and a related method to accommodate fabrics of natural or man-made fibers.

It is a further object of the present invention to provide an apparatus and a related method that, in addition to knitted fabrics, likewise is usable for non-woven textiles, papers, papers with additives, and the like.

It is a further object of the present invention to provide an apparatus which accommodates automatic operational features including programable logic control.

It is a further object of the present invention to apply compaction optimally for volumetric reduction of knitted textile and similar fabrics.

It is a further object of the present invention to allow interlocked loops of knitted fabrics to compact by movement of their loops orthogonally each relative to its related stitch rows which may be skewed, bent, warped and/or twisted.

It is a further object of the present invention to accommodate expansion of fibers of the knitted fabric by application of heat and/or moisture thereto. The fibers puff and partially unravel as the loops move toward each other.

It is a further object of the present invention to set and hold compaction that has been achieved.

It is a further object of the present invention to provide an apparatus that is inexpensive to build, is versatile and reliable; as well as to present a related method that is simple and easy to operate and to adjust.

It is a further object of the present invention to provide an apparatus and related method that are knit-friendly and operator-friendly producing knitted textile fabrics and similar fabrics which are manufacturer-friendly and most of all wearer-friendly.

It is a further object of the present invention to accommodate compaction of the widest variety of knitted fabrics including sensitive fabrics, gauze materials and the like.

It is still further object of the present invention to reduce power requirements of the apparatus.

It is a further object of the present invention to conserve space requirements of the apparatus.

Applicant achieves the foregoing objectives by providing a compressive shrinking apparatus and related method for a web or a tube of knitted textile fabric of natural and/or man-made fibers, or of a similar fabric, With a retarder surface moving at a substantially lower surface speed than the surface speed of a paired entry surface and with a compression zone formed between the surfaces. Width of a gap in the compression zone can be controlled by movement of the retarder surface and/or the entry surface toward or away from each other and by resilient loading applied thereto. The compression zone is arranged to be in-line and unobstructed. The web of fabric is contained preferably resiliently as it is passed from the feeding surface into the compression zone, through the compression zone and as it leaves the compression zone. The fabric preferably is heated and pre-moistened and the surfaces preferably are heated.

DESCRIPTION OF DRAWINGS the foregoing and other important objects and advantages of the present invention will become apparent from the following detailed description, taken in conjunction with accompanying drawings, wherein like numerals refer to like items throughout and in which:

FIG. 1 is a simplified and idealized schematic side view of a double belt embodiment of the invention, without extraneous parts being shown, and with knitted fabric passing between two oppositely traveling juxtaposed elastomeric belts and with an entry slip sheet projecting from upstream on one of the belts to serve as a slippery input confining means and with an output side slip sheet projecting from downstream on the other of the belts to serve as the a slippery output confining means.

BLOSSARY OF NUMERICAL DESIGNATIONS

Figure 1:
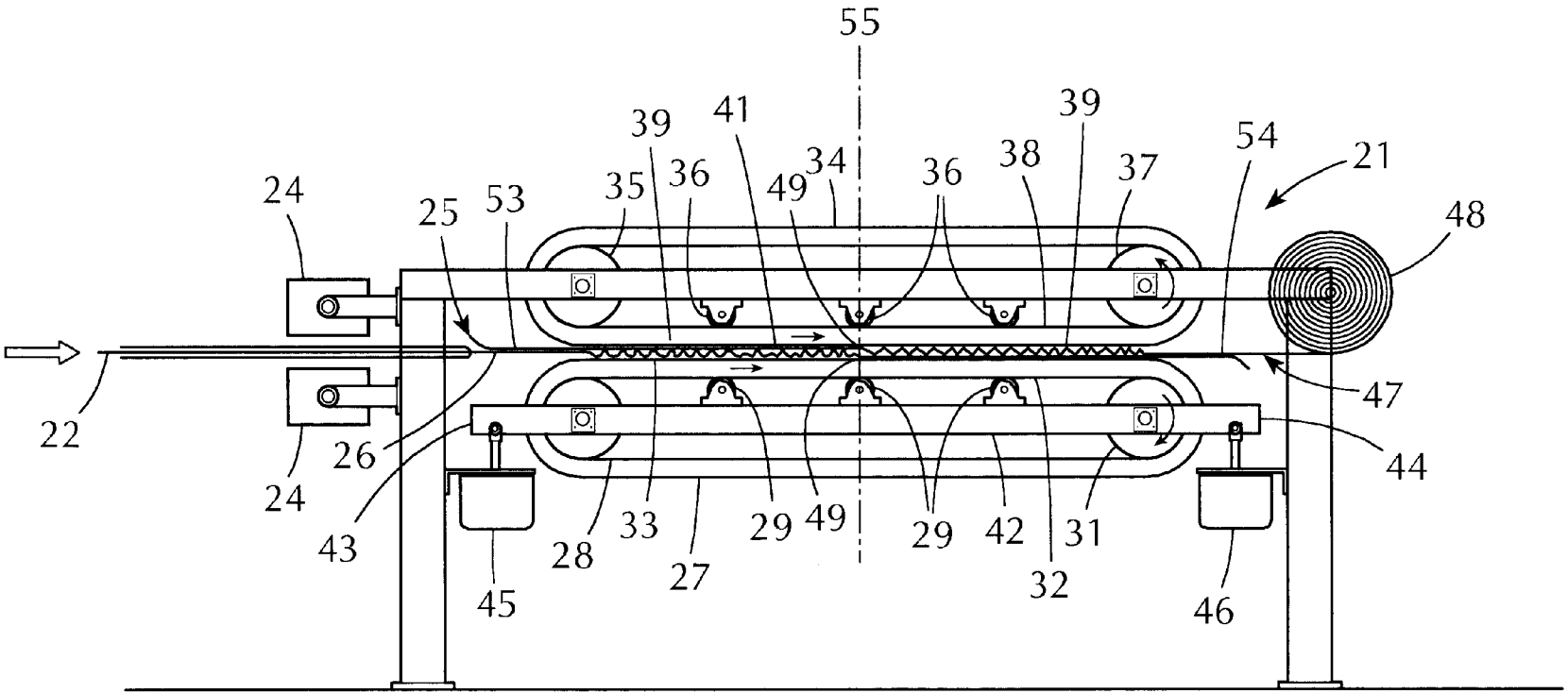

21. compactor (generally designated)
22. knitted tube of shrinkable fabric
23. spreader
24. steam chamber
25. entry means
26. none
27. entry belt
28. entry idler roller
29. entry stabilizer rollers
30. none
31. entry driven roller
32. straight flat entry run
33. flat clockwise traveling entry surface
34. retarder belt
35. retarder idler roller
36. retarder stabilizer roller
37. retarder driven roller
38. straight flat retarder run
39. flat counterclockwise traveling retarder surface
40. none
41. gap
42. chassis
43. one end of chassis
44. other end of chassis
45. one pneumatic cylinder
46. another pneumatic cylinder
47. exit means generally designated
48. spool
49. compression zone
50. none
51. interlocked loops of yarn
52. stitch rows
53. entry slip sheet

54. retarder slip sheet
55. plane marking beginning of retarder slip sheet
56. transverse orientation of fabric
57. feeder roller
58. retarder roller
59. feeder roller axis
60. none
61. retarder roller axis
62. nip plane
63. confined entry path
64. exit shoe
65. one side of fabric
66. opposite side of fabric
67. none
68. pneumatic cylinder
69. springs
70. none
71. entry shoe
72. pneumatic cylinder
73. spring
74. spring loaded tension roller
75. tube slicer

DESCRIPTION OF PREFERRED EMBODIMENTS

Figure 2:
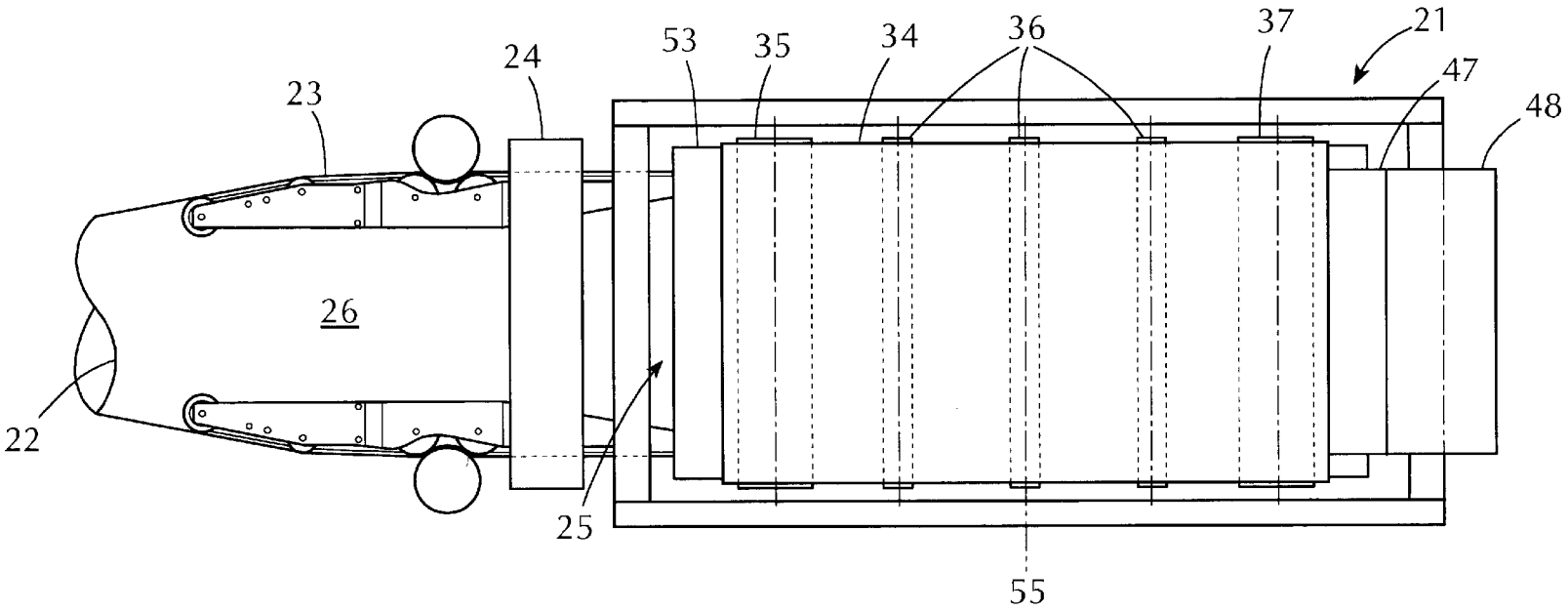
FIG. 2 is a simplified and idealized schematic top plan view of the double belt embodiment, without extraneous parts being shown, and looking down on FIG. 1, and further extended upstream to show spreading of a knitted textile.

One embodiment of the present invention is shown in FIGS. 1 and 2 as a compactor generally designated 21 comprising twin endless belts. The compactor 21 treats a knitted tube of shrinkable fabric 22 delivered from a source (not shown) via a spreader 23 seen in FIG. 2. The particular fabric shown by way of an example in FIGS. 1 and 2 arrives dry so it is first heated and moistened by steam from steam chambers 24 whereby fibers of the fabric partially unravel and expand.

Entry means (generally designated 25) shown in FIGS. 1 and 2 receive a tube of the fabric 22 in a flattened double thickness onto an entry belt 27 organized for clockwise travel over an entry idler roller 28 and entry stabilizer rollers 29 by means of an entry driven roller 31. The entry belt 27 forms a straight, flat entry run 32, preferably horizontal, which presents a flat clockwise traveling entry surface 33.

Retarder means are shown in FIG. 1 as a retarder belt 34 organized for endless counterclockwise travel over a retarder idler roller 35 and retarder stabilizer rollers 36 be means of a retarder driven roller 37. The retarder belts 34 forms a straight, flat retarder run 38 which presents a flat counterclockwise traveling retarder surface 39 juxtaposed close to the entry surface 33 and spaced therefrom by a gap 41. The gap 41 is set at approximately a double thickness 26 of the fabric 22. The entry and retarder stabilizer rollers 29, 36 keep the entry and retarder belts 27, 34 from waving and maintain the gap 41 at a substantially uniform width. The entry idler roller 28 and the entry driven roller 31 are journaled on a chassis 42 which is supported at both of its ends 43, 44 by pneumatic cylinders 45, 46 which provide pressure for resilient loading of the entry belt 27 against pressure exerted by thickness variation and irregularity of any particular fabric 22 as it passes between the entry belt 27 and the retarder belt 34 to exit means generally designated 47 for winding of the fabric 22 as shown onto a spool 48, or folding the fabric which is not shown.

Both the entry surface 33 and the retarder surface 39 are sufficiently frictive or organized otherwise to engage with and carry along the fabric 22. In the gap 41 a compression zone 49 occurs. Location and extent of the compression zone 49 are illdefined and difficult to delineate specifically. The compression zone 49 varies from fabric to fabric, depending upon fabric 22 thickness, construction, irregularity, orientation of interlocked loops of yarn 51 relative to their stitch rows 52 and according the skewed bent and twisted orientation of the stitch rows 52 as well as lubricity, friction, unraveling and puffing of the fibers, pressure on the fabric and perhaps other variables. It is easier to deal with the compression zone 49 than it is to specify precisely where it starts and where it ends. Width of the gap 41 is set by elevation of the chassis 42. Pneumatic loading of the cylinders 45, 46 applies resilient loading on the fabric 22 in the gap 41 whereby width of the gap 41 varies according to needs of the fabric 22 as will be discussed more fully herein.

The retarder surface 39 moves to the right in FIG. 1 in a same direction with the entry surface 37. The retarder surface 39 travels at a slower speed than the speed of the entry surface 33 so that the fabric 22 is compacted therebetween in and about the compression zone 49. In-line organization of the compression zone 49 enables the fabric 22 to be delivered to the compression zone 49, compacted, and discharged from the compression zone 49 without being subjected to mechanical obstructions, such as kinks, crimps, notches, blades, bends or the like, so that compaction can take place in and about the compression zone 49 without drawbacks imposed by such obstructions.

An entry slip sheet 53 serves as means to eliminate friction between the retarder surface 39 and the fabric 22 upstream of the compression zone 49 so that the entry surface 33 can deliver the fabric 22 to the compression zone 49 without interference from the retarder belt 34. During its delivery to the compression zone 49 the fabric 22 is confined between the entry slip sheet 53 and the entry surface 33 so that the fabric 22 is restrained from expanding. Thickness of slip sheets such as 53, 54 are typically from 5 to 10 thousandths of an inch (5/1000"–10/1000") for most fabrics. In the compression zone 49 the fabric 22 passes without substantial change of direction from the entry surface 33 through the in-line compression zone 49 to the slower retarder surface 39 whereby the fabric 22 is compacted as will be discussed more fully herein.

A retarder slip sheet 54 serves as means to eliminate friction between the entry surface 33 and the fabric 22 downstream of the compression zone 49 so that the retarder surface 39 can discharge the compacted fabric 22 free of interference from the entry belt 27. During the discharge of the fabric 22 it is confined between the retarder slip sheet 54 and the retarder surface 39 downstream of the compression zone 49 so that the fabric 22 is prevented from expanding and the compaction achieved in and about the compression zone 49 becomes permanently set in the discharged fabric 22 and does not become lost. The slip sheets 53, 54 preferably are heated, expecially the retarder slip sheet 54 to help and assure setting of the compaction.

Advancement means for the entry belt 27 are shown in FIG. 1 as the entry driven roller 31 and advancement means for the retarder belt 34 are shown as the retarder driven roller 37. The entry slip sheet 53 preferably terminates on a first side of the fabric 22 opposite to the entry surface 33 in a plane 55 that marks a beginning of the retarder slip sheet 54 on an opposite second side of the fabric 22 away from the retarder surface 39. The retarder slip sheet 54 is located between the entry belt 27 and the fabric 22 to prevent interference of the entry belt 27 with discharge of the fabric 22 along the retarder surface 39.

It is important that the compression zone 49 be kept in-line and that the retarder slip sheet 54 begin where the entry slip sheet 53 ends. Compaction action is not necessarily limited to a fixed compression zone 49, rather the fabric 22 is enabled to initiate and conclude compacting somewhat freely in and about the compression zone 49 according to factors already set forth herein. A basic objective of the present invention is to eliminate mechanical obstacles such as kinks, crimps, notches, blades, bends or the like being imposed on the fabric 22 in and about the compression zone 49.

Figure 10:
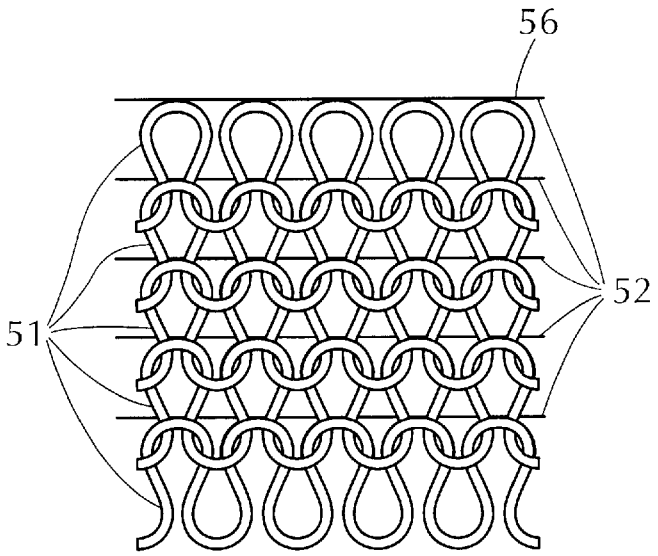
FIG. 10 depicts a portion of a knitted natural textile fabric with ideally aligned stitch rows and interlocked loops of yarn.
Figure 11:
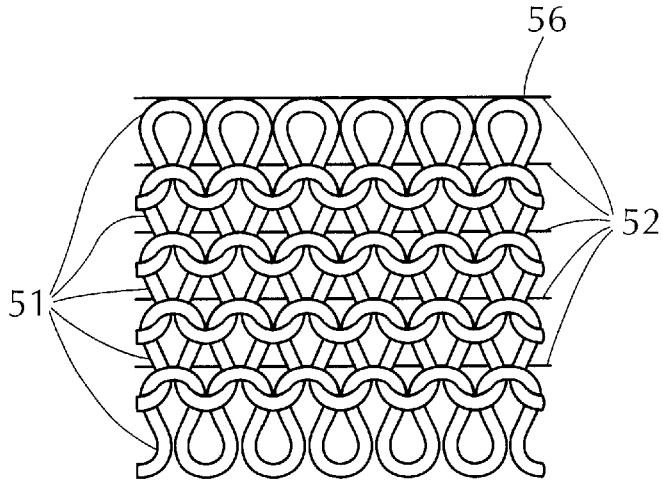
FIG. 11 depicts the same portion of a knitted natural textile fabric shown in FIG. 10 after compressive shrinking according to the present invention, with fibers shown expanded due to partial unraveling and interlocked loops of yarn moved ideally toward each other normal to their stitch rows.
Figure 12:
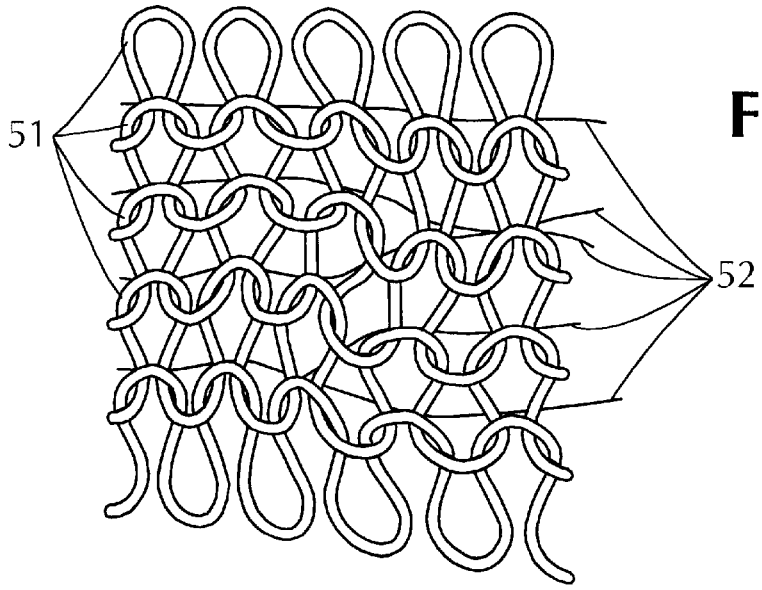
FIG. 12 depicts a portion of a knitted natural textile fabric with stitch rows skewed.
Figure 13:
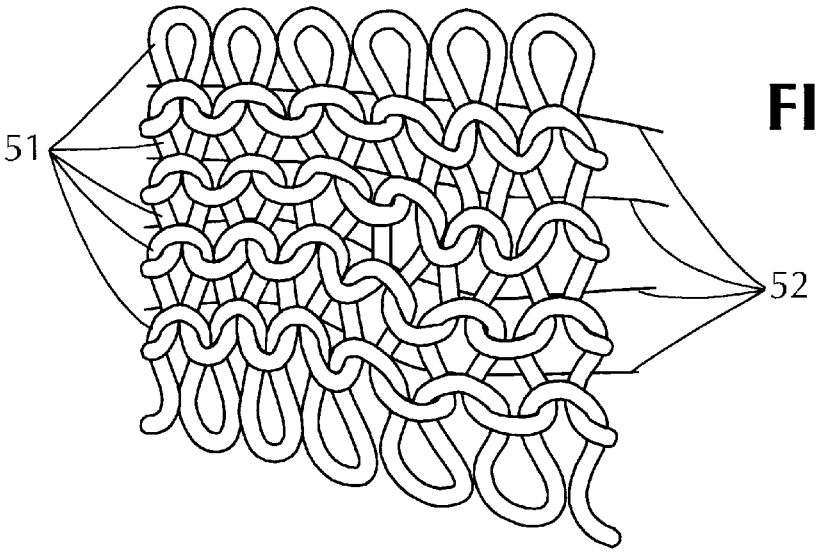
FIG. 13 depicts the same portion of a knitted natural textile fabric shown in FIG. 12 after compressive shrinking according to the present invention, with fibers shown expanded due to partial unraveling and interlocked loops of yarn moved toward each other normal to their stitch rows.

The present apparatus is particularly well suited for shrink-proofing textile knitted fabrics constructed as interlock loops of yarns of natural fibers. The loops 51 of yarn, as seen ideally in FIGS. 10, 11 before and after compaction respectively to interlock along the stitch rows 52. In reality the stitch rows 52 can be foreseen to be curved, bent, twisted and/or otherwise skewed as shown in FIGS. 12 and 13 before and after compaction respectively. The skewing of the stitch rows 52 of a fabric 22 can result from handling, treating, moving of the fabric web 1, from misalignment of equipment, from operator performance, from inherent construction of the fabric, and/or from warping, twisting, recoiling or other distortions originating in or imposed upon fibers, yarns or loops. Knitted textile fabric webs generally are constructed of the loops 51 made of yarns of natural fibers. The loops 51 are interlocked usually along the stitch rows 52 that for various reasons become skewed relative to transverse orientation 56 of the fabric 22 shown in FIG. 10.

Applicant has observed that a natural tendency of interlock loops 51 is for them to move efficiently toward each other during compaction so as to reduce their volume without superfluous movement. Accordingly, by arranging travel of the fabric 22 in-line through the apparatus, avoiding mechanical obstacles, and recognizing that the stitch rows 52 likely become skewed, Applicant freed, rather than, tortured the loops 51 to seek their own best way to close toward each other to reduce volume of the fabric. This relative movement of the loops 51 occurs in and/or about the compaction zone 49. Also during compaction the fibers of the yam partially unravel and tend to bulk, usually because they are being subjected to heat and moisture, which also results in the loops 51 becoming shorter and thicker as seen from comparison of FIG. 11 with FIG. 10 and FIG. 13 with FIG. 12. It is important that the fabric 22 be confined preferably resiliently as it approaches the compression zone 49 and it is even more important that the fabric 22 be confined preferably resiliently and heated as it is discharged from the compression zone 49 so that loss of compaction does not occur.

Rotary equipment is popular, relatively easy to operate, and generally is expected to involve fewer potential operating and maintenance risk than do endless belts. As shown in FIGS. 3–6, Applicant's teaching likewise is adaptedable to a single-station two-roller rotary apparatus. In a rotary embodiment shown FIG. 3 a fabric web 22 having a fabric thickness 26 is introduced and confined via an entry confining means 25, shown as an entry slip sheet 53 to pass through an in-line compression zone 49 in a nip gap 41 located between a feeder roller 57 and a retarder roller 58. The fabric 22 is discharged thereafter via an exit confining means. In or about the compression zone 49 the fabric 22 is compacted in somewhat similar manner to the endless belt embodiment of FIGS. 1 and 2. Yet the rotary embodiments of the invention offer greater control in positioning the compression zone 49.

Figure 3:
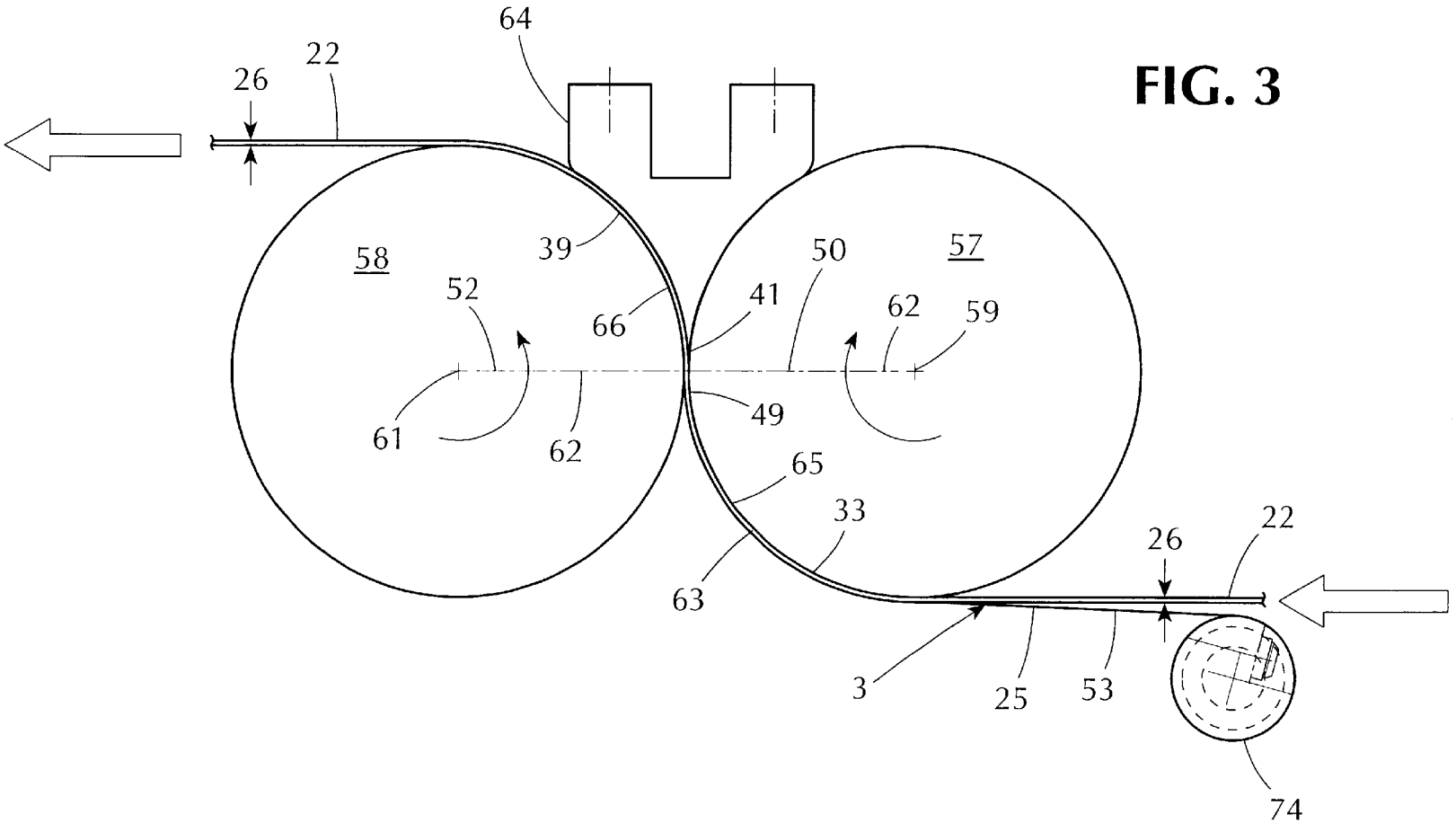
FIG. 3 is a simplified and idealized schematic side sectional view illustrating a rotary compressive shrinking embodiment of the present invention with a feeding roller and a retarding roller, a slip sheet as an entry-side confining means, and a slippery shoe as the exit-side confining means and with a fabric passing upwardly through a compression zone.
Figure 4:
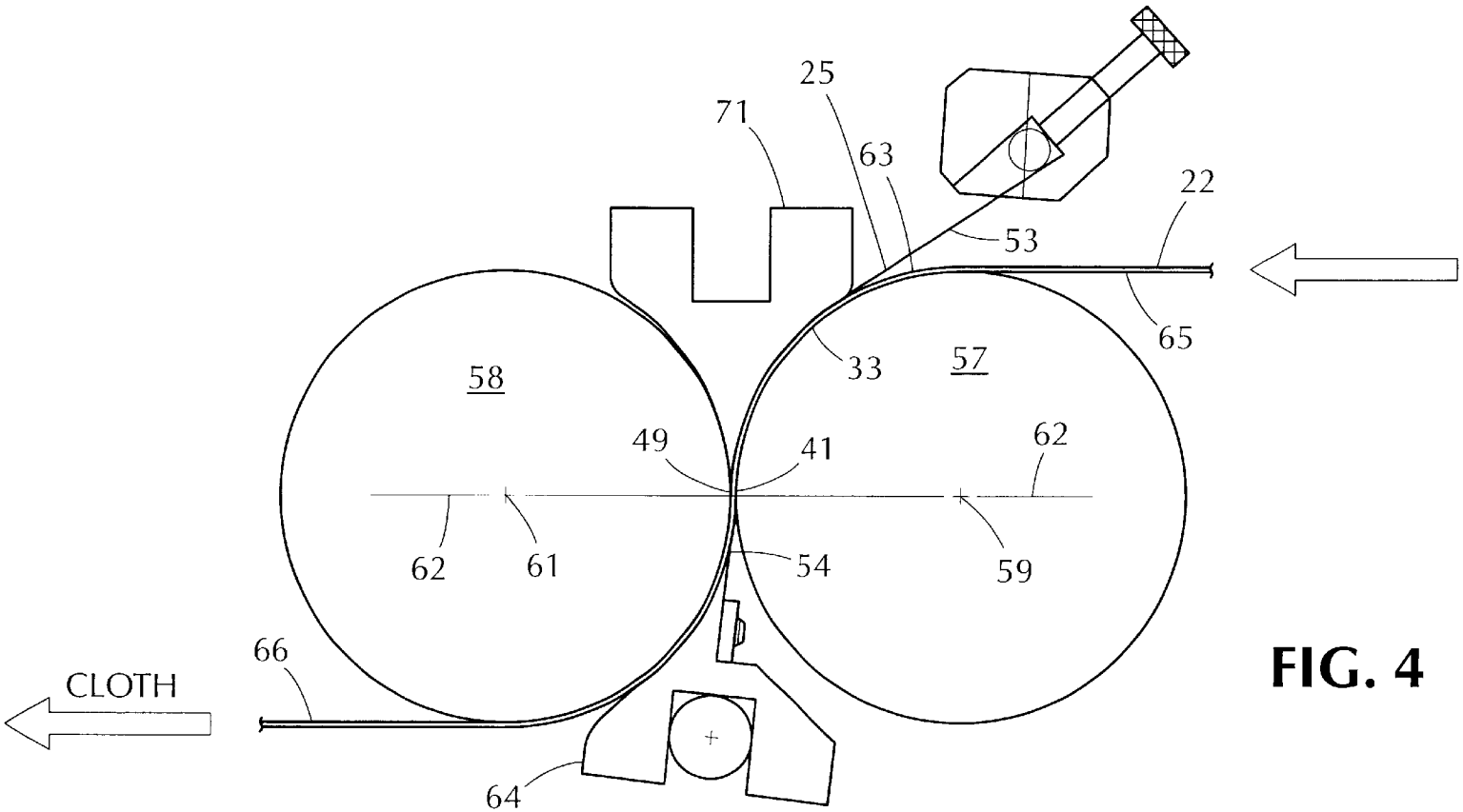
FIG. 4 is a simplified and idealized schematic side sectional view of another rotary compressive shrinking embodiment of the present invention showing a shoe as an entry slip confining means and a shoe as an exit slip confining means and with a fabric passing downwardly through a compression zone.

The feeder roller 57 in FIG. 3 is mounted for rotation clockwise about a feeder roller axis 59 and the feeder roller 57 presents an entry surface 33. The retarder roller 58 is mounted for counterclockwise rotation about a retarder roller axis 61 and the retarder roller 58 presents a retarder surface 39. The respective axes 59, 61 of the feeder roller 57 and of the retarder roller 58 are each arranged parallel to the other. The two axes 59, 61 define and are included in a nip plane 62 passing though a region in which the rollers 57, 58 most closely approach each other.

The entry confining means 25 comprises the entry slip sheet 53 which conforms to the entry surface 33 and forms therewith a confined entry path 63 for advancement of the fabric 22 in engagement with the entry surface 33. The exit confining means 47 includes an exit shoe 64 which cooperates with the retarder surface 39 to confine the fabric 22 against the retarder surface 39.

In FIG. 3, the feeder roller 57 and the retarder roller 58 form between them the compression zone 49 as an in-line gap 41 generally tangent to both the entry surface 33 and to the retarder surface 39 and generally normal to the nip plane 62. The feeder roller 57 and the retarder roller 58 at the nip plane 62 are spaced apart a distance which in a knitted tube is substantially equal to double the thickness 26 of the fabric 22. If the fabric 22 is in the form of an open web the distance would be substantially equal to a single thickness of the fabric. As will be discussed more fully herein, resilient loading of one or both of the rollers 57, 58 and/or of the entry confining means 25 and/or of the exit confining means 47, provided typically by pneumatic means or by springs, allows the gap 41 to change in width according to thickness variations and irregularity of the fabric 22 being compacted therein.

Figure 6:
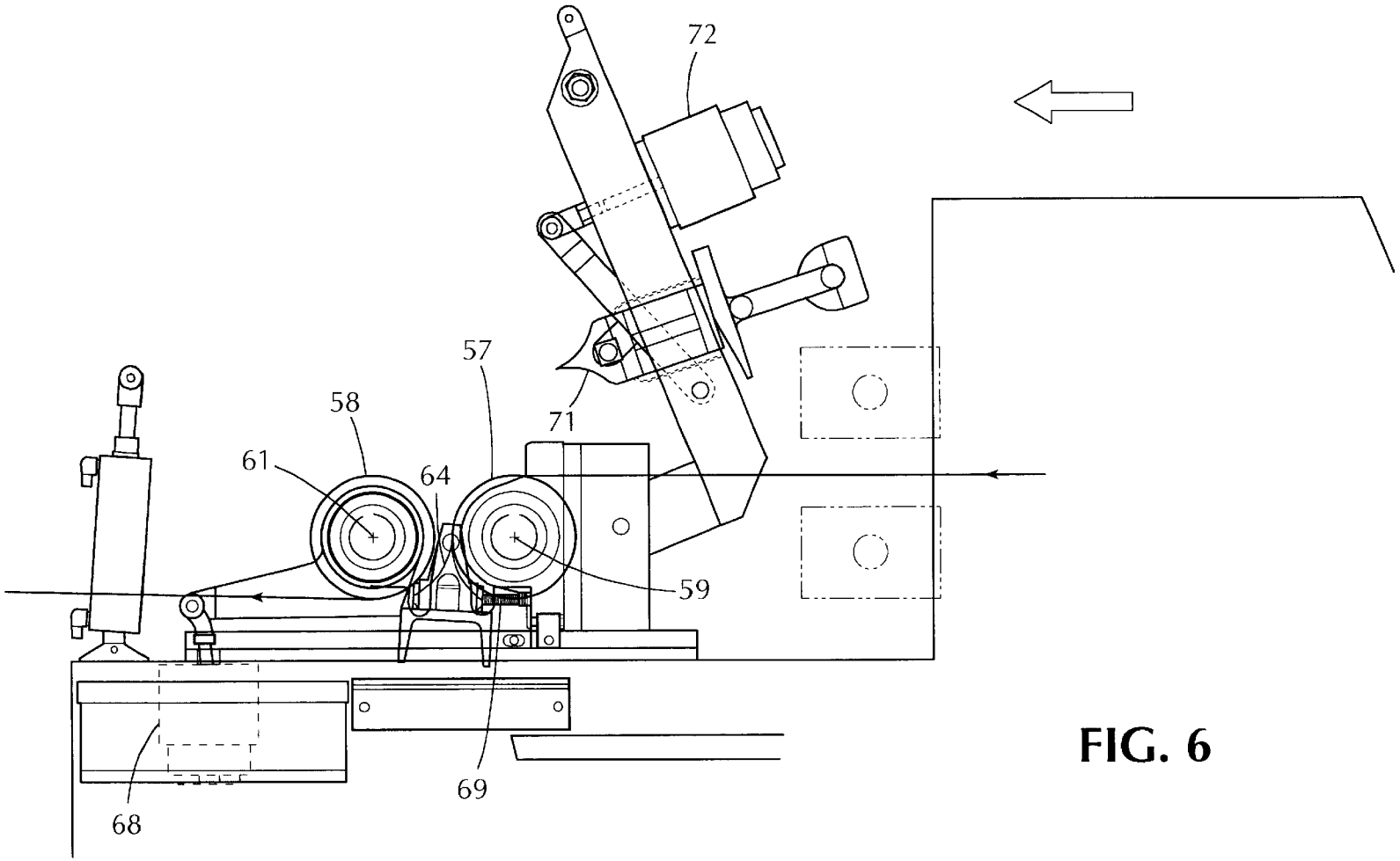
FIG. 6 is another simplified side elevational view similar in ways to FIG. 5 but with its yoke open and showing pneumatic loading of an input shoe.
Figures 7A, 7B, 7C:
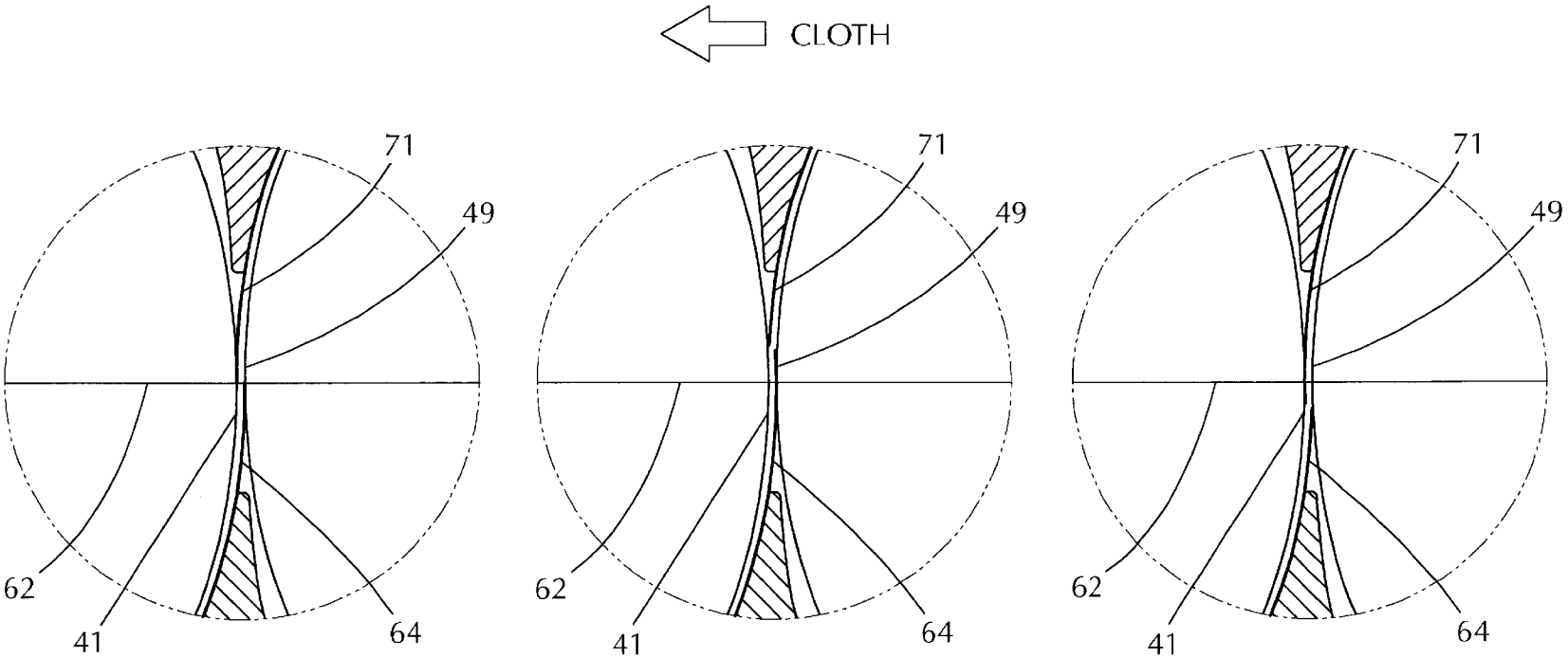
FIGS. 7A, 7B and 7C are enlarged simplified cross sectional illustrations focusing on the compression zone and depicting various locations of the slip sheets relative to the nip plane.

As shown in FIGS. 7A, 7B and 7C, the entry slip sheet 53 (or a shoe or the like used in its stead) penetrates downwardly into the compression zone 49 to the nip plane 62 as shown in FIG. 7A, to above the nip plane 62 as shown in FIG. 7B or to below the nip plane 62 as shown in FIG. 7C. Correspondingly the retarder slip sheet (or a shoe or the like used in its stead) penetrates upwardly into the compression zone 49 to the nip plane 62 as shown in FIG. 7A, to below the nip plane 62 as shown in FIG. 7B or to above the nip plane 62 as shown in FIG. 7C. The entry 53 and retarder 54 slip sheets or shoes or the like provide between them an in-line unobstructed path for the fabric 22 free of obstacles such as bends, crimps, kinks, abrupt angle changes, The entry slip sheet 53 ends where the retarder slip sheet begins so that the fabric 22 is in contact with the feeder roller 57 then in contact with the retarder roller 58 to avoid scorching, polishing, crimping or grabbing of the fabric 22. In the embodiments shown in FIGS. 4, 5 and 6 the fabric 22 passes downwardly through the compression zone as in FIGS. 7A, 7B and 7C. For passage of the fabric 22 upwardly through the compression zone 49 the foregoing penetrations of the slip sheets 53, 54 relative to the nip plane 62 would be reversed.

The compression zone 49 is short and in-line substantially on a tangent of both rollers 57, 58 and normal to the nip plane 62. However, depending upon sizes of the rollers 57, 58, the fabric 22 may be introduced toward the compression zone 49 and discharged from the compression zone 49 at a small angle (less than twenty degrees) whereby some smooth, gradual change of direction takes place. Said change of direction is manageable and does not adversely affect in-line compaction of the rotary embodiment of the apparatus so long as the fabric 22 is confined to the entry path and the exit path 47 and the slip sheets 43, 54 adequately channel the fabric 22 through the compression zone 49.

Figure 5:
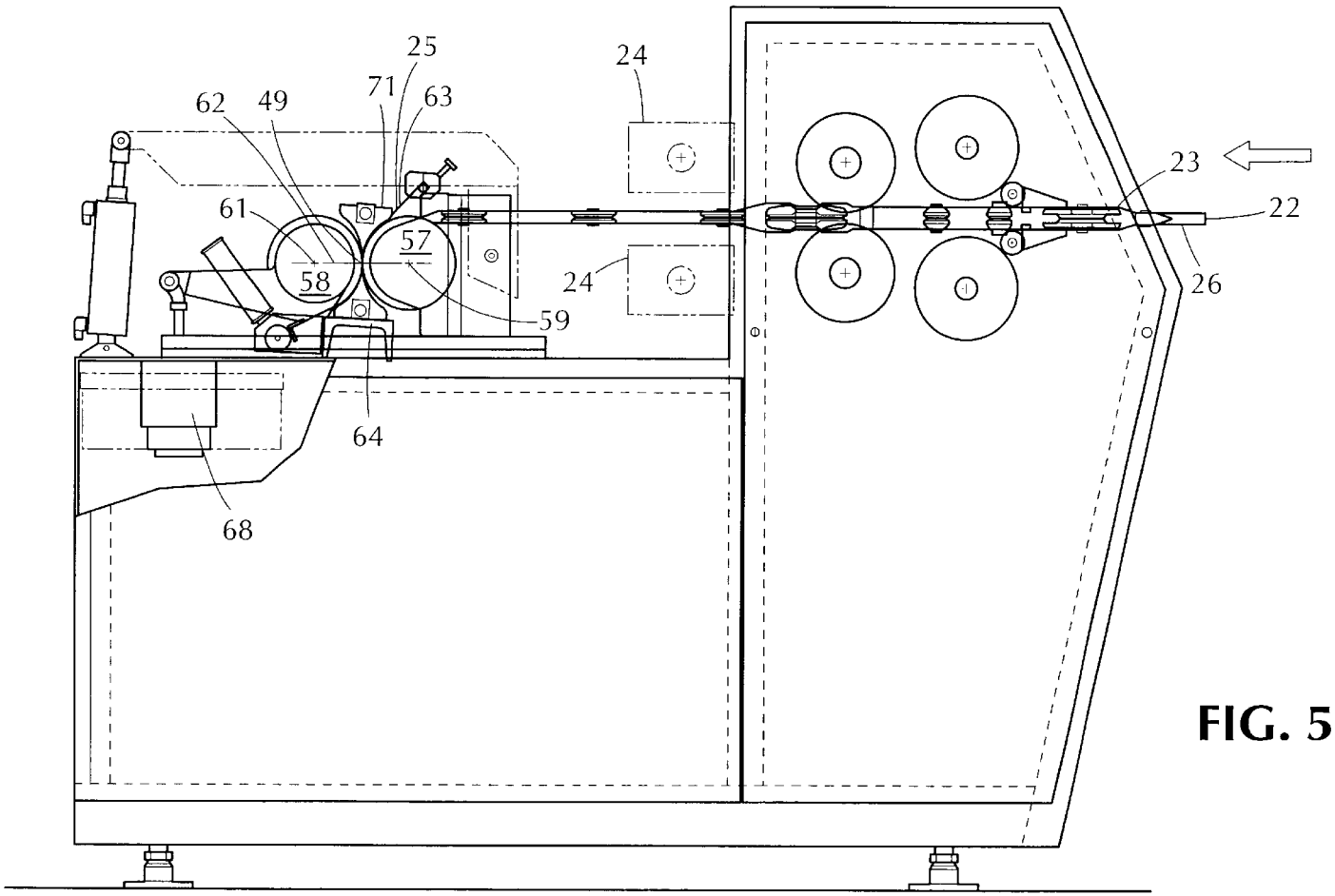
FIG. 5 is a simplified side elevational view of one embodiment of a rotary compressive shrinkage range showing its overall commercial form with superfluous parts eliminated for clarity of presentation.

As seen in FIGS. 5 and 6, adjusting means, in the form of pneumatic pressure from a cylinder 68 is used for adjustably positioning the feed roller 57 and the retarder roller 58 relative to each other initially to set the gap 41 width of the compression zone 49 and then to accommodate yielding as may be required by thickness variation and irregularity of the fabric 22 in the compression zone 49. One or both of the exit shoe 64 and the entry shoe 71 are loaded by means of springs 69 or by pneumatic pressure from cylinder 72 to control width of the entry path 63, width of the exit path 47 and to permit limited pneumatic temporary yielding relief of the gap 41 according to thickness variation and irregularity of the fabric 22 being compacted therein. By way of example, mounting arrangement of the shoe assemblies can be substantially in accordance with Edmund A. Diggle Jr. U.S. Pat. No. 3,973,303, the disclosure of which is incorporated herein by reference. For an example of construction of a single-station two-roller compressive shrinkage apparatus, roller and shoe construction and basic operation serving as background for the present invention, reference can be made to William D. Milligan et al. U.S. Pat. No. 5,016,329 the disclosure of which is incorporated herein by reference. The spreader can be of the type illustrated in Frezza U.S. Pat. No. 4,103,402. Slitting and opening of the tubes can be according to U.S. Pat. Nos. 3,196,723 and/or 3,581,614 disclosures of which are also incorporated herein by reference.

The entry slip sheet 53 or entry shoe 71 penetrates into the compression zone 49 to maintain the in-line orientation of the compression zone 49 and to avoid kinks, crimps, notches, blades, bends or similar obstructions from being introduced into a path of the fabric 22 through the compression zone 49.

The retarder roller 58 in FIGS. 3–6 is rotatable counterclockwise, while the feeder roller 57 is rotatable clockwise so that the fabric 22 travels from introduction by the feeder roller 57 through the compression zone 49 and is discharged via the retarder roller 58. The retarder roller 58 is rotatable at a speed such that the linear speed of the retarder surface 39 in the region of the nip plane 62, is less then the linear speed of the entry surface 33 whereby the fabric 22 is compacted. The feeder roller 57 and the retarder roller 58 engage opposite sides 65, 66 of the fabric 22 in seriatim, first the entry surface 33, then the retarder surface 39 .

The feed roller 57 and the retarder roller 58 in FIGS. 3–6 preferably are of equal diameters. However the diameters could be different each from the other. Adjustment of the input slip sheet 53 in FIG. 3 is by resilient tension imposed by spring-loaded tension roller 74. The pressure and positioning of the slip sheet could also be adjusted by means of an entry shoe 71.

Figure 8:
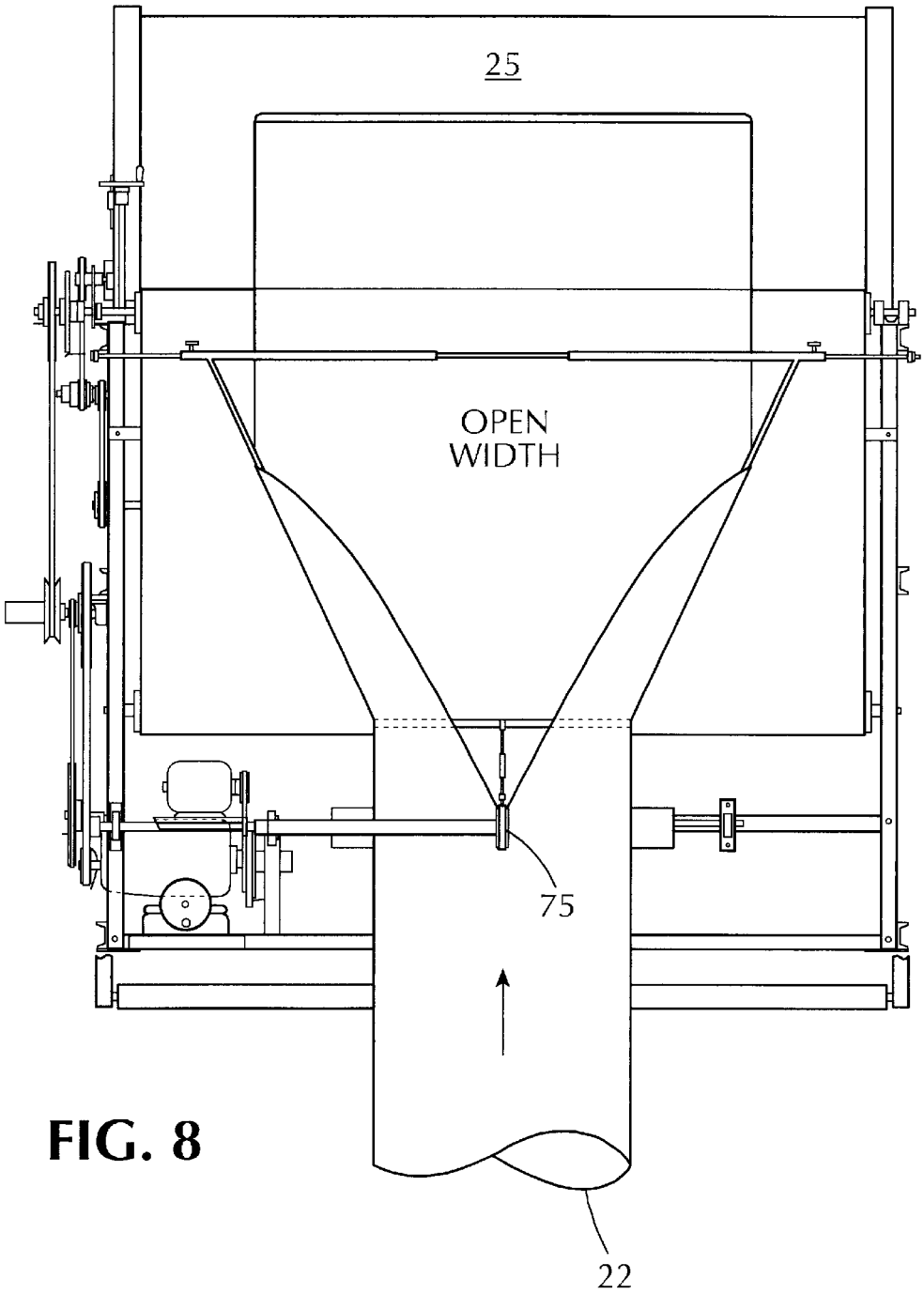
FIG. 8 is a top plan view showing a textile fabric tube being opened and fed as an open web to a compressive shrinkage apparatus.
Figure 9:
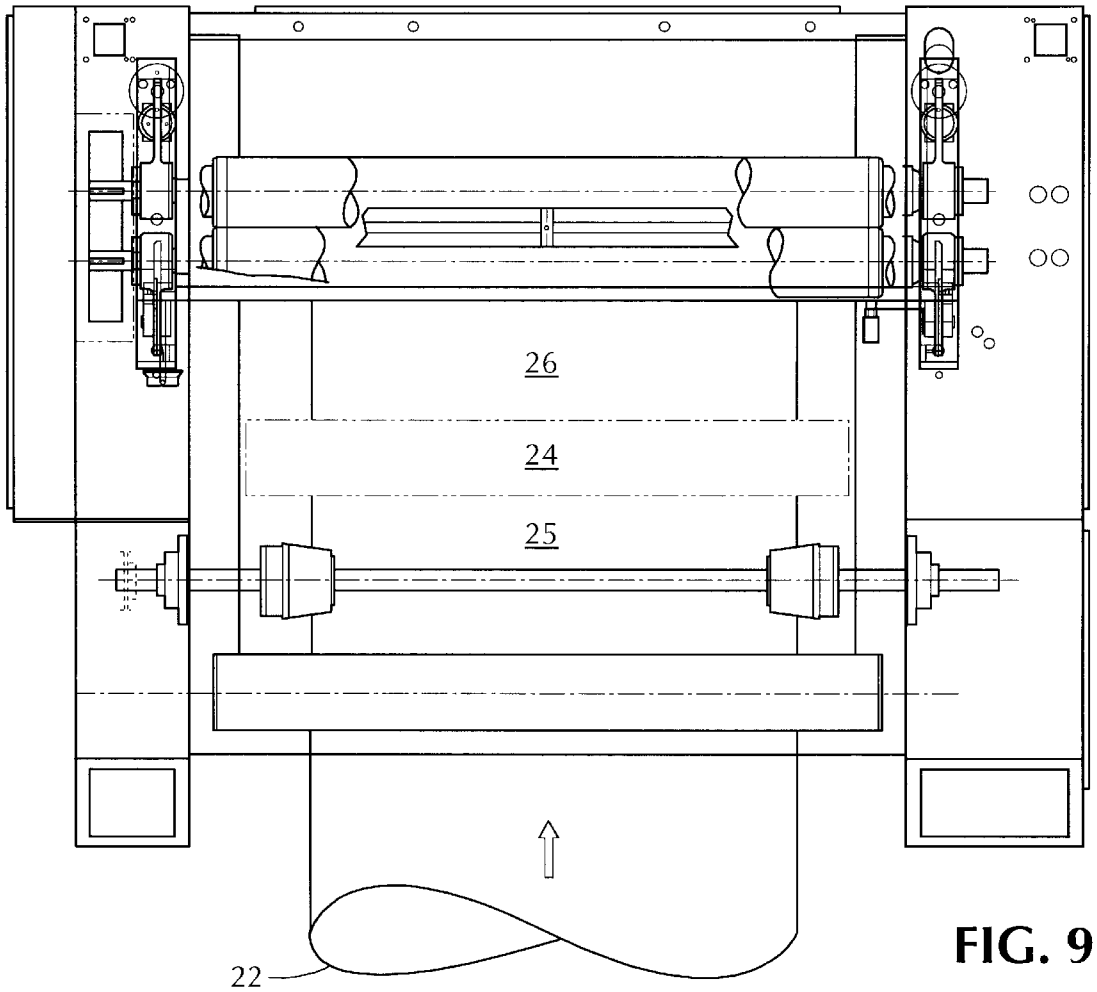
FIG. 9 is a top plan view depicting feed of a textile fabric in tubular form to a compressive shrinkage apparatus.

FIG. 5 depicts a typical shrinkage compactor set up to accommodate a knitted textile fabric tube made typically of interlocked loops made of natural fibers received in tubular form. The fabric can be compacted in either tubular form or it can be split open by a slicer 75, as shown in FIG. 8, spread preferably by means well known in the art, such as a tenter frame, heated and/or moisturized by means of steam boxes 24 for introduction to the feeder roller 57. Alternately an open web of the fabric after slicing could be heated, moistened and introduced directly to the feeder roller 57. After discharge from the retarder roller 58 the compacted fabric web or tube is usually folded or rolled.

The retarder surface 39 can be made of a resilient material or it may be made of a metal construction having a roughened surface for gripping the web. The feeder roller 57 usually is of metal construction and it may also be provided with a roughened surface for gripping the fabric 22.

FIG. 6 depicts an embodiment, in an open condition, of a rotary compressive shrinkage range incorporating compressive shrinkage apparatuses according to the present invention. In the embodiment of FIG. 6 the fabric is introduced over the feeder roller 57 under resilient pressure from the entry shoe 71 determined by the pneumatic cylinder 72. The fabric web then passes for compaction through the compression zone 49 and exits via the retarder roller 58 under resilient pressure from an exit shoe 64 determined by the pneumatic cylinder 68 and spring 73. In operation, typically the gap 41 between the cylindrical rollers 57, 58 is set and resilient pressure thereon by pneumatic cylinder 68 is set so that width of the gap 41 is determined by action of the fabric web 1 against said pressure. Entry shoe 71 and exit shoe 64 are fitted to their respective rollers 57, 58 and each of the shoes 71, 64 has a predetermined pneumatic pressure applied thereto by means of the pneumatic cylinders 68, 72. The fabric 22 is confined against expansion by each of the shoes. Distance of each of the shoes 71, 64 relative to its associated roller 57, 58 varies according to force exerted by action of the fabric 22 against pressures of pneumatic cylinders 68, 72 and the spring 73.

One or both of the shoes 64, 71 are heated because heat helps set the shrinkage. As yarn loops 51 are compacted some unraveling is useful because increase in yarn diameter helps keep shrink-proofing of the yarn from falling out. In wet compaction, yarn fibers tend to unravel in their last ten percent (10%) of drying.

Although the present Application has been described in connection with knitted textile fabrics formed from interlocked loops made of natural fibers, it should be understood that the invention is similarly applicable to compaction of man-made fibers, non-woven fabrics, papers, papers impregnated with other substances and similar fabrics which have characteristics more commonly associated with knitted textile fabrics than with woven textile fabrics.

It should also be apparent to those skilled in the art that wide deviations may be made from the foregoing preferred embodiments without departing from a main theme of invention defined in claims which follow.

I claim:

1. A compressive shrinkage apparatus for a tube of fabric in a flattened condition, the fabric having a fabric thickness, the apparatus comprising:

a feeder roller mounted for rotation about a feeder axis, the feeder roller having a feeder surface;

a retarder roller mounted for rotation about a retarder axis, the retarder roller having a retarder surface, the retarder roller arranged parallel to the feeder roller;

the feeder axis and the retarder axis defining a rip plane passing through a region in which the feeder roller and the retarder roller most closely approach each other;

the feeder roller and the retarder roller having between them a compression zone in the vicinity of the nip plane;

the feeder roller and the retarder roller at the nip plane being spaced apart a distance substantially equal to double the fabric thickness;

an entry confining means conforming to the feeder surface and defining therewith an entry path for advancement of the tube of fabric in contact with the feeder roller to the compression zone;

an exit confirming means conforming to the retarder surface and defining therewith an exit path for discharge of the tube of fabric from the compression zone directly to an exit confining means in contact with the retarder roller;

the entry confining means extending into the compression zone;

the retarder roller in the region of the nip plane rotatable in an opposite sense from the feeder roller and at a slower linear speed than the feeder roller so that confronting surfaces of the respective feeder and retarder rollers engage in seriatim opposite sides of the tube of fabric for compacting of the tube of fabric; and the compression zone organized to be in-line.

2. The compressive shrinkage apparatus as claimed in claim 1 with the entry confining means penetrating into the compression zone to beyond the nip plane and the exit confining means penetrating into the compression zone short of the nip plane.

3. The compressive shrinkage apparatus as claimed in claim 1 with the entry confining means penetrating into the compression zone to the nip plane and the exit confining means penetrating into the compression zone to the nip plane.

4. The compressive shrinkage apparatus as claimed in claim 1 with the entry confining means penetrating into the compression zone short of the nip plane and the exit confining means penetrating into the compression zone to beyond the nip plane.

5. The compressive shrinkage apparatus for a tube of fabric as claimed in claim 1, and further comprising biasing means to adjustably position the retarder roller relative to the feeder roller for accommodating change of width of the compression zone.

6. A compressive shrinkage apparatus for a tube of knitted textile fabric, in a flattened condition, the fabric having a fabric thickness, the knitted textile fabric having interlocked loops arranged along stitch rows, the apparatus comprising:

a feeder roller mounted for rotation about a feeder axis and having a feeder surface;

a retarder roller mounted for rotation about a retarder axis and having a retarder surface, the retarder roller arranged closely adjacent to and parallel with the feeder roller;

the feeder axis and the retarder axis defining a nip plane passing through a region in which the feeder roller and the retarder roller most closely approach each other;

the feeder roller and the retarder roller having between them a compression zone in the vicinity of the nip plane;

the feeder roller and the retarder roller at the nip plane being spaced apart a distance substantially equal to double the fabric thickness;

an entry fabric confining means conforming to the feeder roller and defining therewith a confined entry path for advancement of the tube of the fabric by engagement with the feeder roller to the compression zone;

an exit confining means conforming to the retarder surface and defining therewith a confined exit path for discharge of the tube of fabric from the compression zone directly to the exit confining means by engagement with the retarder roller;

the entry fabric confining means extending into the compression zone;

advancing means comprising the feeder surface and the retarder surface rotating in an opposite sense from each other and engaging opposite surfaces of the tube of fabric for confined and controlled passage of the tube of fabric during transit form the entry fabric confining means through the compression zone to the exit fabric confining means; and the compression zone organized to be in-line whereby the interlocked loops of the knitted fabric are pushed toward each other orthogonally substantially each of the loops relative to its related stitch row causing the knitted textile fabric to shrink in volume.

7. The compressive shrinkage apparatus as claimed in claim 6, with the entry fabric confining means penetrating into the compression zone.

8. The compressive shrinkage apparatus as claimed in claim 6, with the entry confining means penetrating into the compression zone to beyond the nip plane and the exit confining shoe penetrating into the compression zone short of the nip plane.

9. The compressive shrinkage apparatus as claimed in claim 6 with the entry confining means penetrating into the compression zone to the nip plane and the exit confining means penetrating into the compression zone to the nip plane.

10. The compressive shrinkage apparatus as claimed in claim 6 with the entry confining means penetrating into the compressions zone short of the nip plane and the exit confining means penetrating into the compression zone to beyond the nip plane.

11. The compressive shrinkage apparatus as claimed in claim 6, with the entry fabric confining means being a slip sheet, the exit fabric confining means being a shoe.

12. The compressive shrinkage apparatus as claimed in claim 6, with the entry fabric confining means and the exit fabric confining means each being a shoe.

13. The compressive shrinkage apparatus as claimed in claim 6, with the entry fabric confining means and the exit fabric confining means each being a slip sheet.

14. The compressive shrinkage apparatus as claimed in claim 6, and further comprising biasing means for selectively adjustably positioning the retarder roller relative to the feeder roller to adjust width of the compression zone and for biasing to accommodate thickness variation and irregularities of any particular tube of knitted textile fabric being compacted in the compression zone.

15. The compressive shrinkage apparatus as claimed in claim 6, with the feeder roller and the retarder roller each equal to the other in diameter.

16. The compressive shrinkage apparatus as claimed in claim 6, with the feeder roller and the retarder roller each unequal to the other in diameter.

17. The compressive shrinkage apparatus as claimed in claim 6 with entry adjustment means for resiliently adjustably positioning the entry confining means relative to the feeder roller to control pressure on the tube of fabric in the entry path and to bias according to pressure from thickness variation and irregularities of any particular tube of fabric in the entry path.

18. The compressive shrinkage apparatus as claimed in claim 17 with the entry adjustment means comprising fluid actuator means and adjustable pressure regulating means therefor.

19. The compressive shrinkage apparatus as claimed in claim 6, with exit adjustment means for resiliently adjustably positioning the exit confining means relative to the retarder roller to control pressure on the tube of fabric in the exit path and to bias according to pressure from thickness variation and irregularities of any particular tube of fabric in the exit path.

20. The compressive shrinkage apparatus as claimed in claim 19, with the exit adjustment means comprising fluid actuator means and adjustable pressure regulating means thereof.

21. The compressive shrinkage apparatus as claimed in claim 18, with separate and independently controllable means for heating the retarder roller and the exit fabric confining means.

22. The compressive shrinkage apparatus as claimed in claim 20, with separate and independently controllable means for heating the feeding roller and the entry confining means.

23. The compressive shrinkage apparatus as claimed in claim 6, with the retarder surface made of a resilient material.

24. The compressive shrinkage apparatus as claimed in claim 6, with the retarder surface made of a non-resilient material.

25. The compressive shrinkage apparatus as claimed in claim 6, with the feeder roller being of metal construction and having a roughened surface for gripping the tube of fabric.

26. The compressive shrinkage apparatus as claimed in claim 6, with the retarder roller being of metal construction and having a roughened surface for gripping the tube of fabric.

27. A method for compressively shrinking a continuous tube of knitted fabric in a flattened condition, the fabric having a fabric thickness, the method comprising steps as follows:

organizing a feeder roller having a feeder surface and a retarder roller having a retarder surface, with each of the rollers positioned adjacent the other and with each of the rollers having an axis parallel to the axis of the other roller, the axes defining a nip plane;

spacing the feeder surface and the retarder surface of the respective rollers apart a distance substantially equal to double the thickness of the fabric, with the surfaces having between them a compression zone where the rollers most closely approach each other;

confining the tube of fabric by means of an entry slip sheet against the feeder surface in an entry path for advancement of the fabric into the compression zone, and providing an exit shoe with a nadir for confining the fabric against the retarder surface in an exit path while discharging the tube of fabric from the compression zone;

rotating the rollers with the retarder at a retarder surface speed slower than a feeder surface speed of the feeder roller, and with each of the rollers rotating in a sense opposite to the other so that confronting respective feeder and retarder surfaces engage in seriatim opposite sides of the tube of fabric for reducing volume of the fabric and controlling passage of the web through the compression zone; and organizing the compression zone to be in-line whereby interlocked loop pairs of the knitted fabric are pushed toward each other orthogonally substantially each of the loops relative to its skewedly oriented stitch row causing the knitted textile fabric to reduce in volume.

28. The method for compressively shrinking a continuous tube of fabric as claimed in claim 27, and introducing biasing means for adjustably positioning the retarder roller to the feeder roller for varying width of the compression zone.

29. The method for compressively shrinking a continuous tube of fabric as claimed in claim 28, and arranging the entry slip sheet to contact the retarder surface.

30. The method for compressively shrinking a continuous tube of fabric as claimed in claim 27, and providing the rollers of equal diameter.

31. The method for compressively shrinking a continuous tube of fabric as claimed in claim 27, and providing the rollers of unequal diameter.

32. A method for compressively shrinking a tube of knitted textile fabric having loops formed from one or more yams made of natural and/or man-made fibers, the loops organized along successive stitch rows arranged substantially transversely to a path of travel of the tube, each of the loops interlocked with a paired other of the loops orthogonally relative to and across an associated one of the stitch rows, the method comprising steps of:

organizing a feeder roller having a feeder surface and a retarded roller having a retarded surface, with each of the rollers positioned adjacent the other and with each of the rollers having an axis parallel to the axis of the other roller, the axes defining a nip plane;

spacing the feeder surface and the retarder surface apart a distance substantially equal to double the thickness of the fabric, with the surfaces having between them a compression zone where the rollers most closely approach each other;

confining the tube of fabric in a heated and moistened condition by means of an entry slip sheet against the feeder surface in an entry path for advancement of the fabric into the compression zone, and providing exit confining means for confining the fabric against the retarder surface in an exit path to control expansion of the fabric while discharging the tube of fabric from the compression zone;

rotating the rollers with the retarder roller at a retarder surface speed slower than a feeder surface speed of the feeder roller, and with each of the rollers rotating in a sense opposite to the other so that confronting respective portions of the feeder surface and of the retarder surface engage in seriatim opposite sides of the tube of fabric for reducing volume of the fabric and controlling passage of the web through the compression zone; and organizing the compression zone to be in-line whereby the interlocked loop pairs of the knitted fabric are pushed toward each other orthogonally across their associated stitch row to eliminate unwanted tension in the fabric and to compensate for skewed, wavy or non-linear orientation of the stitch rows from perpendicular orientation with the path of travel of the tube, and the yam unravels and expands to fill interstices between the stitches thereby preventing further shrinkage when the fabric is washed and dried as a garment.

* * * * *

UNITED STATES PATENT AND TRADEMARK OFFICE

CERTIFICATE OF CORRECTION

PATENT NO. : 6,681,461 B1
DATED : January 27, 2004
INVENTOR(S) : Frank Catallo

It is certified that error appears in the above-identified patent and that said Letters Patent is hereby corrected as shown below:

Column 12,
Line 54, “rip” should be -- nip --.

Signed and Sealed this

Thirteenth Day of April, 2004

JON W. DUDAS
*Acting Director of the United States Patent and Trademark Office*

UNITED STATES PATENT AND TRADEMARK OFFICE

CERTIFICATE OF CORRECTION

PATENT NO. : 6,681,461 B1
DATED : January 27, 2004
INVENTOR(S) : Frank Catallo

It is certified that error appears in the above-identified patent and that said Letters Patent is hereby corrected as shown below:

Column 3,
Line 22, “yam” should be -- yarn --.

Column 5,
Line 47, “the a” should be -- the --.

Column 12,
Line 17, “1” should be deleted.

Signed and Sealed this

Eighth Day of June, 2004

JON W. DUDAS
*Acting Director of the United States Patent and Trademark Office*